United States Patent [19]

Klaus

[11] Patent Number: 4,486,140

[45] Date of Patent: Dec. 4, 1984

[54] DEVICE FOR THE PARKING OF AUTOMOBILES

[76] Inventor: Kaspar Klaus, Dr. Berndl-Str. 5, D 8940 Memmingen, Fed. Rep. of Germany

[21] Appl. No.: 437,020

[22] Filed: Oct. 27, 1982

[30] Foreign Application Priority Data

Oct. 31, 1981 [DE] Fed. Rep. of Germany ..... 3143321

[51] Int. Cl.[3] ..... E04H 6/06

[52] U.S. Cl. ..... 414/229

[58] Field of Search ..... 414/227-229

[56] References Cited

U.S. PATENT DOCUMENTS 3,924,760 12/1975 Lendi ..... 414/229

*Primary Examiner*—Robert G. Sheridan

*Attorney, Agent, or Firm*—Holman & Stern

[57] ABSTRACT

In a device for parking automobiles use is made of two platforms arranged one above the other and of devices for lifting and tilting these platforms. The latter devices include cooperating trackways, for example flanged rails, coacting with guide rollers on the platforms. The trackways are substantially rectilinear and arranged at an acute angle to one another so as to tilt the platforms during the lifting motion. The degree of inclination thereby achieved can be varied by an adjusting mechanism.

7 Claims, 6 Drawing Figures

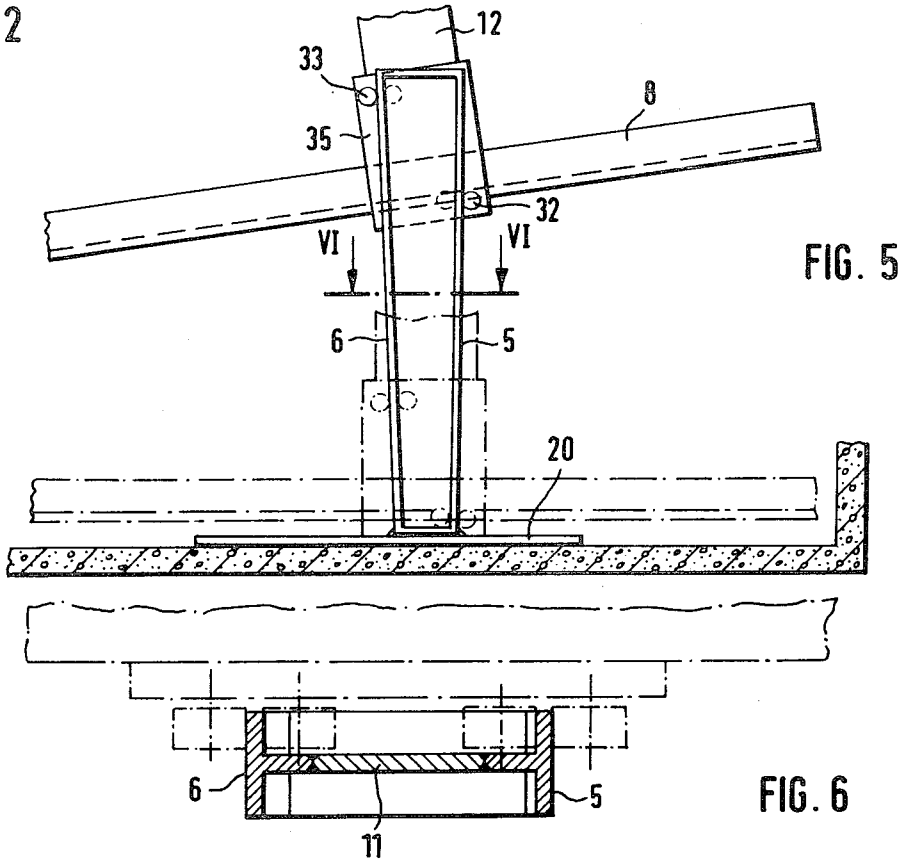
FIG. 5
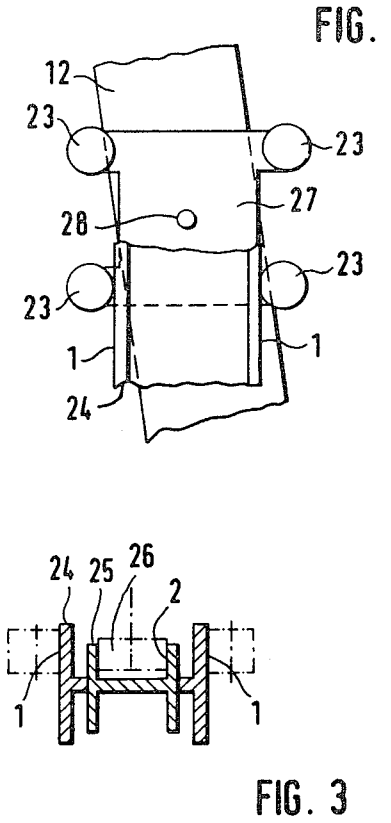
FIG. 6
FIG. 2
FIG. 3

DEVICE FOR THE PARKING OF AUTOMOBILES

BACKGROUND OF THE INVENTION

This invention relates to a device for the parking of automobile vehicles comprising two interconnected platforms spaced heightwise one over the other and means for lifting and tilting said platforms, such lifting and tilting means including trackways arranged at each of the two sides of the platform assembly and guide elements such as rollers connected to the platforms.

In parking devices of this nature it is desirable to hold the platforms tilted during the drive-in preparation of the lower platform so that the complete lifting motion of the platform is less and is reduced to the amount dictated by the heightwise space available.

In known parking devices it is found that with the arrangement of the guide elements over one another the trackway system projects above the drive-in even when the platforms have been lowered. In many cases this is undesirable.

A particular parking device of this nature is for example described in DE-OS No. 2913661. The trackway system is fixed and the guide elements, for example rollers, which are guided by rails of the trackway system, are mounted on the platforms which, in this case are rigidly coupled together. The rail arrangement is curved and comprises a lower and an upper part. The guide elements of the lower part move substantially in a rectilinear path. The guide bodies of the upper part are however laterally deflected from the curvature over a short rectilinear path to produce the required tilting during the lift.

BRIEF SUMMARY OF THE INVENTION

It is an object of the present invention to improve a parking device of the form set forth and keep the structural height to a minimum.

A further object is to provide substantial simplification in manufacture.

To meet these desiderata in a parking device of the type set forth above it is proposed that the aforementioned trackways shall be substantially straight and extend alongside or within one another to define an acute angle between them.

This proposed structure according to the invention secures various important advantages. The fact that substantially rectilinear trackways are used can substantially reduce the overall height of the trackway arrangement. As a result of this all the parts of the arrangement can for example readily be arranged in the pit which accommodates the platforms when they are in their lowered position. If the rail arrangements stand up to a small extent, this will often not matter.

The use of rectilinear trackways substantially simplifies the construction. Thus for example commercially available profile irons can be used for the tracks. The required tilting movement is produced by the acute angle relative disposition of the tracks, as a result of which the guide elements cooperating with the trackway produce the tilting motion and these enable the platforms to swing upwards although the trackways themselves extend substantially rectilinearly.

It is clear that in this construction different inclinations of the platforms can be readily obtained by appropriate variation of the acute angle, and in this connection it is important that for example one of the tracks, as is often required, can always remain upright.

BRIEF DESCRIPTION OF THE DRAWINGS

The above and further features of the invention are disclosed in the following description of preferred examples of embodiment thereof diagramatically illustrated in the accompanying drawings, in which:

FIG. 2 illustrates a detail of the construction seen in FIG. 1,

FIG. 3 is a section through the construction of FIG. 1 taken on the line III—III but on a different scale, FIG. 5 is a side view of part of a parking device according to the invention taken from another aspect, and FIG. 6 is a section through a detail of the construction of FIG. 5 on a different scale taken on the section line VI—VI.

DETAILED DESCRIPTION OF THE DRAWINGS

Figure 1:
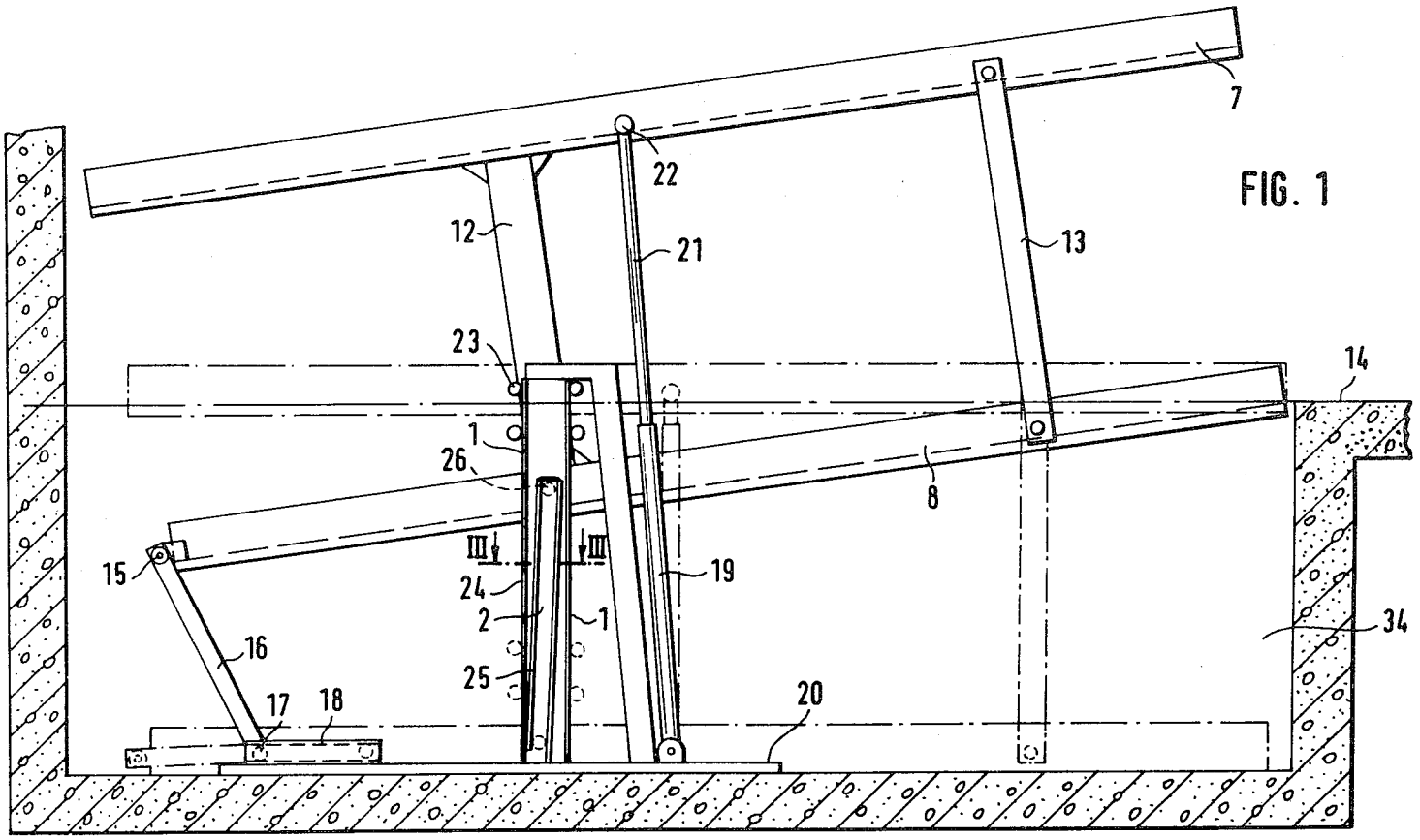
FIG. 1 is a side view of one parking device according to the invention.

In the embodiment of FIGS. 1 to 3 two platforms 7 and 8 are provided and are rigidly connected together by a bracing stay 12. The platforms are also linked by a member 13 which serves as a pull member or stay.

In the lowered condition of the two platforms illustrated in the drawing with dotted lines, the platform 7 lies opposite and adjoins the drive-in 14 and can be used by a vehicle. In the lifted condition, illustrated in the drawing in full line, the lower platform 8 can be driven on to.

A torsion-resisting rod 15 mounted on the leading end of the lower platform 8 extends over the whole width of the platform at this leading end. Each of the ends of this rod 15 has connected thereto an arm 16 and the free end of each arm 16 is mounted by a slide element 17 on a rail 18. The rail 18 is fixed. The arrangement composed of the parts 15–18 prevents lateral tiltings of differently-loaded platforms and establishes uniform movement.

At each of the two sides of the platforms is a cylinder 19 for producing the lift and tilting movements. These cylinders are mounted on the base frame 20 and connected to the upper platform 7 by respective guide rods 21 and 22. It will be noted that the platforms 7 and 8 in the embodiment now being described, as they can be in other embodiments of the invention, may be of a width sufficient to accommodate one vehicle. However double-platform systems of this nature can be provided of a width catering for two vehicles parked side-by-side on one platform.

Provided at the sides of the platforms are trackways 1 and 2 of a rail form guiding arrangement. As can be seen more particularly from the illustrations of FIGS. 2 and 3 the trackway 1 is made as a double-T-rail and guide bodies 23, in the form of rollers, engage the outer side of this trackway.

A double-T-rail 25 is arranged in a recess in the double-T-bearer 24 and constitutes the trackway 2, the corresponding guide body, viz. a roller 26, being guided on the inside of this rail 25.

The rollers 23 are mounted on a support plate 27 pivotally connected to the stay 12.

From FIG. 1 it will clearly be seen that the trackway 2 is disposed at an acute angle of a few degrees to the trackway 1, this acute angle producing the tilting of the platforms 7 and 8 during the lift movement. This happens as a result of the spacing of the roller 26 from the pivotal axis 28 between the plate 27 and the stay 12.

The illustration of FIG. 3 shows clearly that the elements which constitute the trackways 1 and 2 for the platform system at one side can also constitute the trackways for the platforms at the other side, so that for example parking devices of the kind illustrated can be arranged closely side-by-side without any special constructional outlay.

Figure 4:
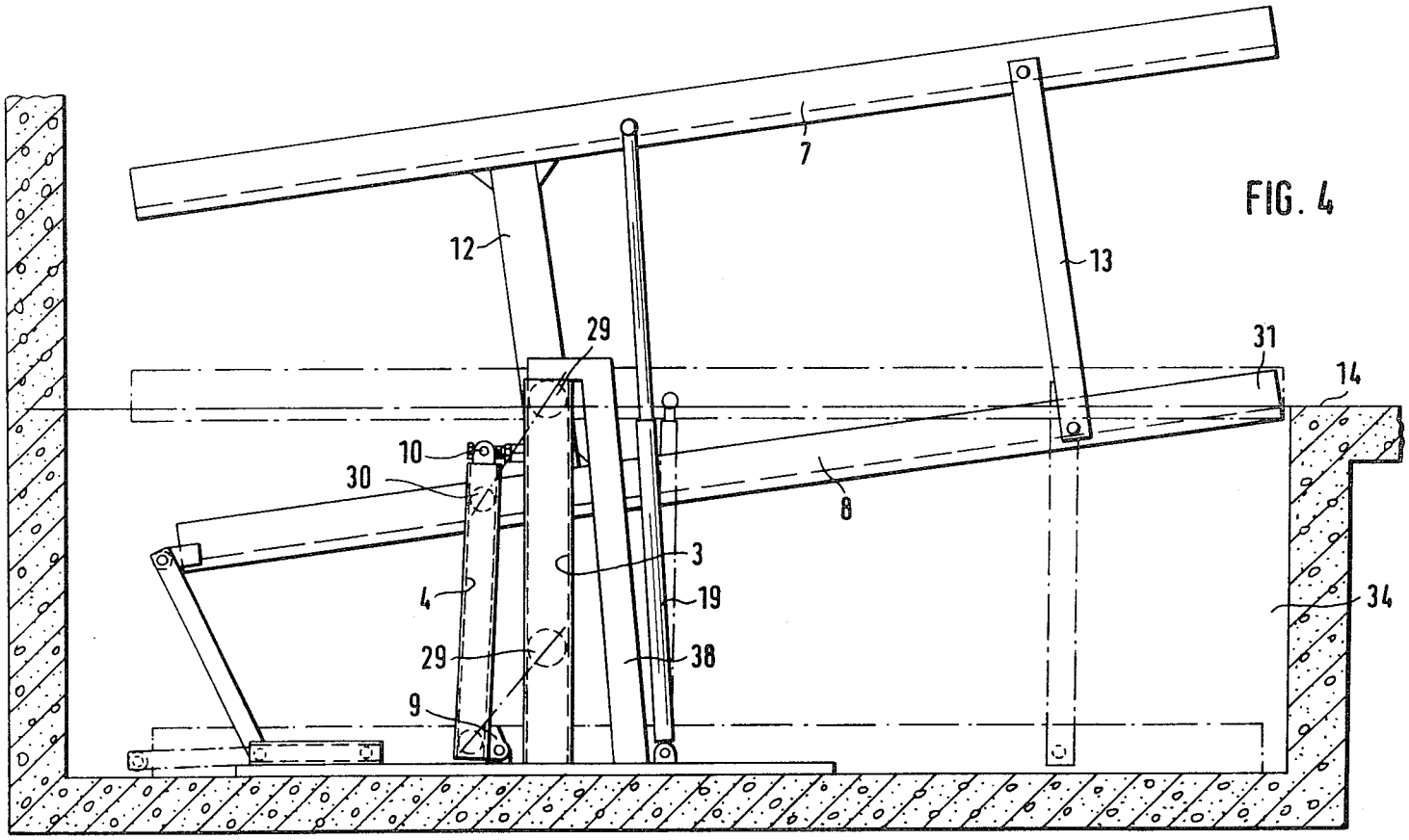
FIG. 4 is a side view of another embodiment of the invention.

The embodiment of FIG. 4 differs from that of FIGS. 1 to 3 primarily in the fact that the trackways, here 3, 4 are arranged side-by-side with a small spacing between them. Struts 38 serve to stiffen the rail arrangement made up of the trackways 3 and 4. Provided at the lowerend of the trackway 4 is a link 9 giving it support on the base frame 20. The upper end of the trackway 4 is connected to trackway 3 through an adjusting mechanism.

The guide bodies, for example the rollers, associated with the trackways 3 and 4 are designated 29 and 30 and are guided at the two sides by the trackways 3 and 4. A connection by means of a plate 27 as illustrated in FIG. 2 is superfluous in this case.

It is possible by means of an adjusting mechanism 10 to vary the inclination of the trackway 4 relatively to that of trackway 3 and, for example in the lifted condition, to suit the height of the ends 31 of the lower platform 8 exactly to the height of the drive-in 14. This will provide for adjustment to suit different installation sites. It will also cater for compensation of manufacturing tolerances in the parking device itself.

It is clear that the advantages prescribed by this invention, as set forth above and as referred to below, are secured particularly when rectilinear trackways are used. If however the trackways are, for example, made slightly curved the advantages of the invention are not lost. This applies particularly to an adjustable construction as shown in FIG. 4.

By means of the adjustability or by varying the angle between the trackways 3 and 4 the movements of the platforms 7 and 8 during the actuation of the cylinders can be varied in other respects.

In particular instances it may be desirable to have the two platforms 7 and 8 levelled in the lifted condition or for these platforms to be parallel to one another in the lifted and lowered conditions. Platform orientation of this nature may be desirable if the surrounding conditions allow and if the platforms are always to be approachable by vehicles in the same direction and at the same angle. The invention provides a way in which this can be achieved with the same component parts in very simple fashion.

It is also an advantage in the present invention that for example the end 31 of the platform 8 during its lift can be set without any particular difficulties to a straight path. This makes it possible for the available space in the pit 34 to be used in optimum fashion.

FIGS. 5 and 6 show a further variant of the invention. In this construction the trackways 5 and 6 are connected by an intermediate part 11 into a common structural unit. The trackway 5 guides the roller pair 32 and the track 36 the roller pair 33. These roller pairs are for example mounted between the platforms 7 and 8 on a bottom enlargement 35 of the stay 12.

In the embodiment illustrated the horizontal spacing of the trackways 5 and 6 narrows upwards. A construction is possible, without anything further, in which the trackways 5 and 6 approach one another at their upper ends so that the rail arrangement, comprising substantially the trackways 5 and 6 and the intermediate part 11, is of good stability with a large base.

FIG. 6 shows clearly that by appropriate construction of the trackway 5 and 6, particularly when in the form of T-profiles, the same rail arrangement can be used for adjacent parking devices.

I claim:

1. A platform assembly for parking automobiles comprising two interconnected platforms spaced heightwise one over the other and means for lifting and tilting said platforms, said lifting and tilting means comprising trackways arranged at each of two sides of the platform assembly and having guide elements connected to the platforms, wherein two trackways of substantially rectilinear form are disposed upright at each side of the platform assembly at an acute angle to one another and wherein said trackways are disposed side-by-side with a small minimal spacing between them.

2. The parking device according to claim 1, further including means for adjusting the acute angle between the trackways.

3. The parking device according to claim 1, in which the trackways at each side of the platform assembly mutually support each other.

4. The parking device according to claim 1 wherein one of the trackways at each side of the platform assembly is pivotally connected at one end thereof to one platform, the other end being connected to the other platform through an inclination adjusting means.

5. The parking device according to claim 1, in which one of a pair of trackways arranged at one side of the platform assembly is disposed within the other trackway of the pair.

6. The parking device according to claim 1, in which the trackways comprise flanged rails.

7. The parking device according to claim 1, in which the trackways are composed of flanged rail, and a pair of such trackways at each side of the platform assembly are coupled by a web-forming part.

* * * * *